US011224962B2

(12) United States Patent
Li

(10) Patent No.: US 11,224,962 B2
(45) Date of Patent: Jan. 18, 2022

(54) EXTENDABLE AND RETRACTABLE WRENCH

(71) Applicant: Yi-Cheng Li, Taichung (TW)

(72) Inventor: Yi-Cheng Li, Taichung (TW)

( * ) Notice: Subject to any disclaimer, the term of this patent is extended or adjusted under 35 U.S.C. 154(b) by 306 days.

(21) Appl. No.: 16/663,594

(22) Filed: Oct. 25, 2019

(65) Prior Publication Data

US 2021/0046633 A1 Feb. 18, 2021

(51) Int. Cl.

| | |
|---|---|
| ***B25G 1/04*** | (2006.01) |
| ***B25B 13/46*** | (2006.01) |
| ***B25B 23/00*** | (2006.01) |

(52) U.S. Cl.

CPC ..... *B25G 1/043* (2013.01); *B25B 13/461* (2013.01); *B25B 23/0028* (2013.01); *B25B 23/0035* (2013.01)

(58) Field of Classification Search

CPC .... B25G 1/043; B25G 1/046; B25B 23/0028; B25B 23/0035; B25B 13/461

See application file for complete search history.

(56) References Cited

U.S. PATENT DOCUMENTS

| | | | | |
|---|---|---|---|---|
| 7,523,689 | B2 * | 4/2009 | Lin | B25B 13/461 81/177.2 |
| 7,878,094 | B2 * | 2/2011 | Lin | B25G 1/043 81/177.2 |
| 8,739,662 | B2 * | 6/2014 | Huang | B25G 1/043 81/489 |
| 9,358,678 | B2 * | 6/2016 | Lai | B25B 13/461 |
| 10,052,750 | B2 * | 8/2018 | Huang | B25G 1/046 |
| 10,688,633 | B2 * | 6/2020 | Lee | B25B 23/00 |
| 2017/0312906 | A1 * | 11/2017 | Chang | B25B 23/16 |
| 2017/0361450 | A1 * | 12/2017 | Chien | B25G 1/063 |
| 2019/0061136 | A1 * | 2/2019 | Huang | B25B 13/463 |

* cited by examiner

*Primary Examiner* — David B. Thomas

(57) ABSTRACT

A wrench includes a tool head, an outer tube unit, a rod unit and a sleeve unit. The outer tube unit includes an outer tube, a tail seat and a biasing member. The tail seat is detachably mounted to the outer tube. The rod unit includes an inner rod telescopically disposed in the outer tube and formed with a plurality of cavities. The biasing member biases the inner rod away from the tail seat. The sleeve unit is slidably sleeved on the outer tube and includes a positioning ball engageable with a selected one of the cavities to prevent the inner rod from moving relative to the outer tube and removable from the selected one of the cavities to allow the inner rod to move relative to the outer tube.

9 Claims, 12 Drawing Sheets

EXTENDABLE AND RETRACTABLE WRENCH

CROSS-REFERENCE TO RELATED APPLICATION

This application claims priority of Taiwanese Utility Model Patent Application No. 108210828 filed on Aug. 15, 2019.

FIELD

The disclosure relates to a hand tool, more particularly to a wrench.

BACKGROUND

Referring to FIGS. 1 to 3, Taiwanese Invention Patent Publication No. 200815159 discloses a conventional telescopic wrench that includes an outer tube 11 extending along a longitudinal direction (L), an inner rod 12 and a sleeve device 13. The inner rod 12 is telescopically disposed in the outer tube 11. The sleeve device 13 is mounted at a front end of the outer tube 11 and is configured to permit and prevent movement of the inner rod 12 relative to the outer tube 11. The sleeve device 13 includes a control sleeve 131, a spring 132 disposed between the outer tube 11 and the control sleeve 131, and two balls 133. The outer tube 11 has an inner surface formed with two receiving holes 111 corresponding in position to the control sleeve 131 so as to allow the balls 133 to be respectively and movably mounted into the receiving holes 111 and partially and respectively project from the receiving holes 111. The inner rod 12 is formed with a plurality of annular grooves 121 spaced apart from one another along the longitudinal direction (L). The control sleeve 131 has a large diameter segment 134 disposed proximate to the front end of the outer tube 11, a small diameter segment 135 connected to and disposed behind the large diameter segment 134 and having a diameter decreasing gradually from the large diameter segment 134 toward a rear end of the outer tube 11.

The control sleeve 131 is movable between a locking position, where the balls 133 extend into a selected one of the annular grooves 121 and are clamped between the small diameter segment 135 and the inner rod 12 to prevent the inner rod 12 from moving relative to the outer tube 11, and an adjustable position, where the receiving holes 111 are aligned with the large diameter segment 134 in the radial direction and the balls 133 are removed from the selected one of the annular grooves 121 to allow the inner rod 12 to move relative to the outer tube 11.

However, during use of the conventional telescopic wrench, a rear end of the inner rod 12 tends to colliding with the rear end of the outer tube 11 when the inner rod 12 is moved rearwardly within the outer tube 11. Consequently, an undesired vibration is caused, which is troublesome to use and adversely affects the operation of the conventional telescopic wrench.

SUMMARY

Therefore, an object of the disclosure is to provide a wrench capable of alleviating at least the drawback of the conventional telescopic wrench.

According to an aspect of the present disclosure, a wrench includes a tool head, an outer tube unit, and a sleeve unit. The outer tube unit includes an outer tube, a tail seat and a first biasing member. The outer tube extends along an axial direction and includes a tube wall that defines a tube channel having a front opening and a rear opening opposite to the front opening along the axial direction. The tube wall has a front segment formed with a positioning hole extending in a radial direction transverse to the axial direction, a rear segment opposite to the front segment along the axial direction, an interconnecting segment interconnecting the front segment and the rear segment and having an inner diameter larger than that of the front segment, and an inner shoulder formed between the front segment and the interconnecting segment. The tail seat is detachably mounted to the rear segment of the outer tube and seals the rear opening. The first biasing member is disposed in the rear segment of the outer tube and is connected to the tail seat.

The rod unit is connected to the tool head, and includes an inner rod and a positioning pin. The inner rod is telescopically disposed in the tube channel and includes an inner end segment, an extending segment, and an outer end segment. The inner end segment abuts against the first biasing member and is formed with a through hole extending in the radial direction therethrough. The extending segment extends from the inner end segment away from the rear opening and is formed with a plurality of cavities spaced apart from one another along the axis. The outer end segment is connected to the extending segment and is exposed outwardly from the front opening. The inner rod is movable telescopically relative to the outer tube to align a selected one of the cavities with the positioning hole of the outer tube in the radial direction. The positioning pin extends through the through hole of the inner rod and has at least one end exposed outwardly of the through hole.

The sleeve unit is slidably sleeved on the outer tube and includes a positioning ball, a movable sleeve and a second biasing member. The positioning ball is mounted movably in and projects partially from the positioning hole of the outer tube. The movable sleeve is movably sleeved on the front segment of the outer tube, and includes a spring mounting segment, a positioning segment, and a large diameter segment. The positioning segment is connected to and disposed in front of the spring mounting segment and has an inner diameter smaller than that of the spring mounting segment. The large diameter segment is connected to and disposed in front of the positioning segment and has an inner diameter larger than that of the positioning segment. The movable sleeve is movable between a locking position, where the positioning ball extends fittingly into the selected one of the cavities and is clamped between the positioning segment of the movable sleeve and the extending segment of the inner rod so as to prevent the inner rod from moving relative to the outer tube, and an adjustable position, where the positioning hole is aligned with the large diameter segment in the radial direction and the positioning ball is received in the large diameter segment and is removed from the selected one of the cavities so as to allow the inner rod to move relative to the outer tube The at least one end of the positioning pin of the telescopic rod unit comes into contact with the inner shoulder formed between the front segment and the interconnecting segment of the outer tube when the extending segment of the inner rod is moved forwardly within the outer tube, so as to prevent the inner rod from being detached from the outer tube through the front opening. The second biasing member is sleeved on the outer tube, is disposed in the spring mounting segment of the movable sleeve, and biases the movable sleeve toward the locking position.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
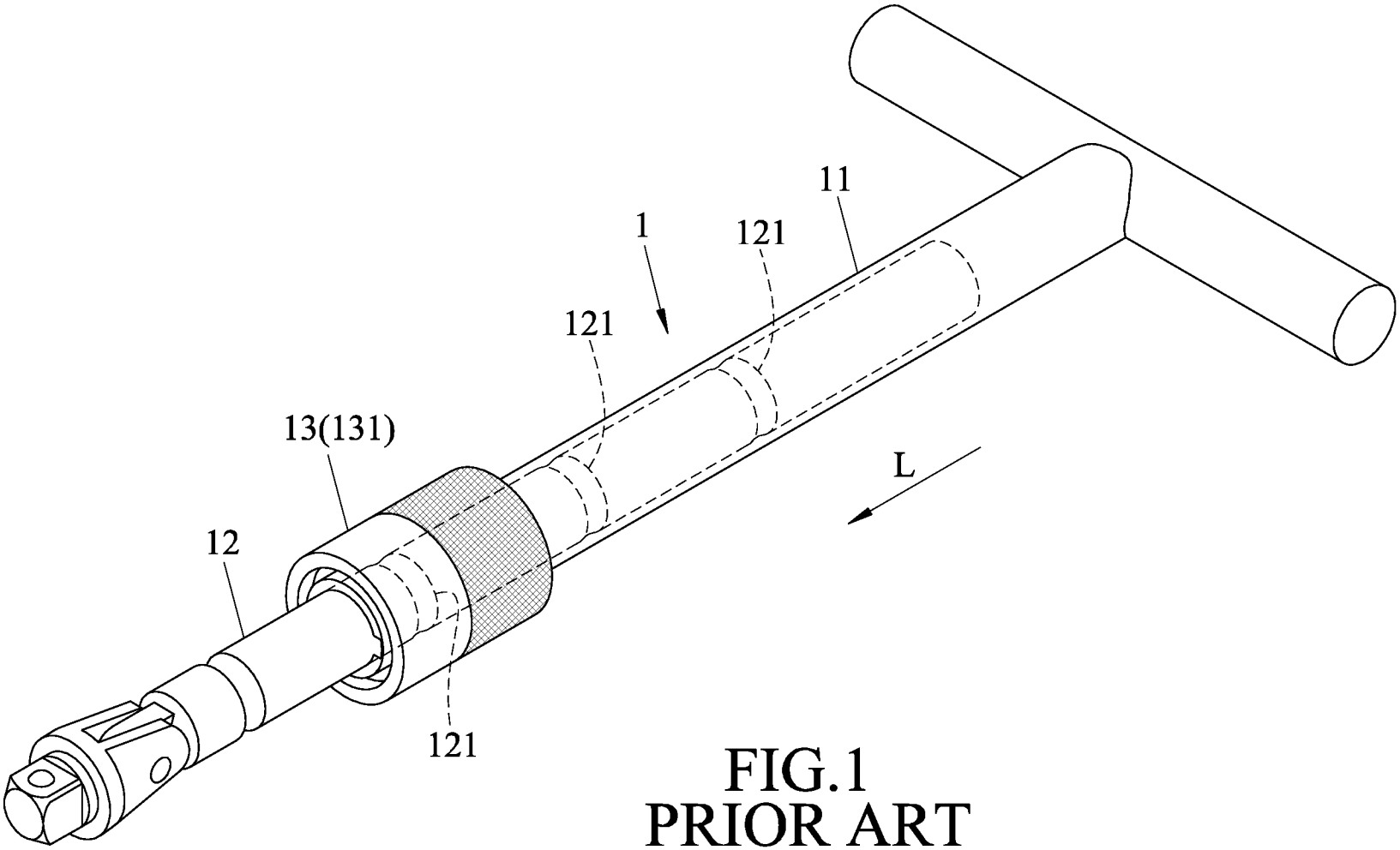
FIG.1 PRIOR ART
FIG. 1 is a schematic perspective view of a conventional telescopic wrench of Taiwanese Invention Patent Publication No. 200815159.
Figure 2:
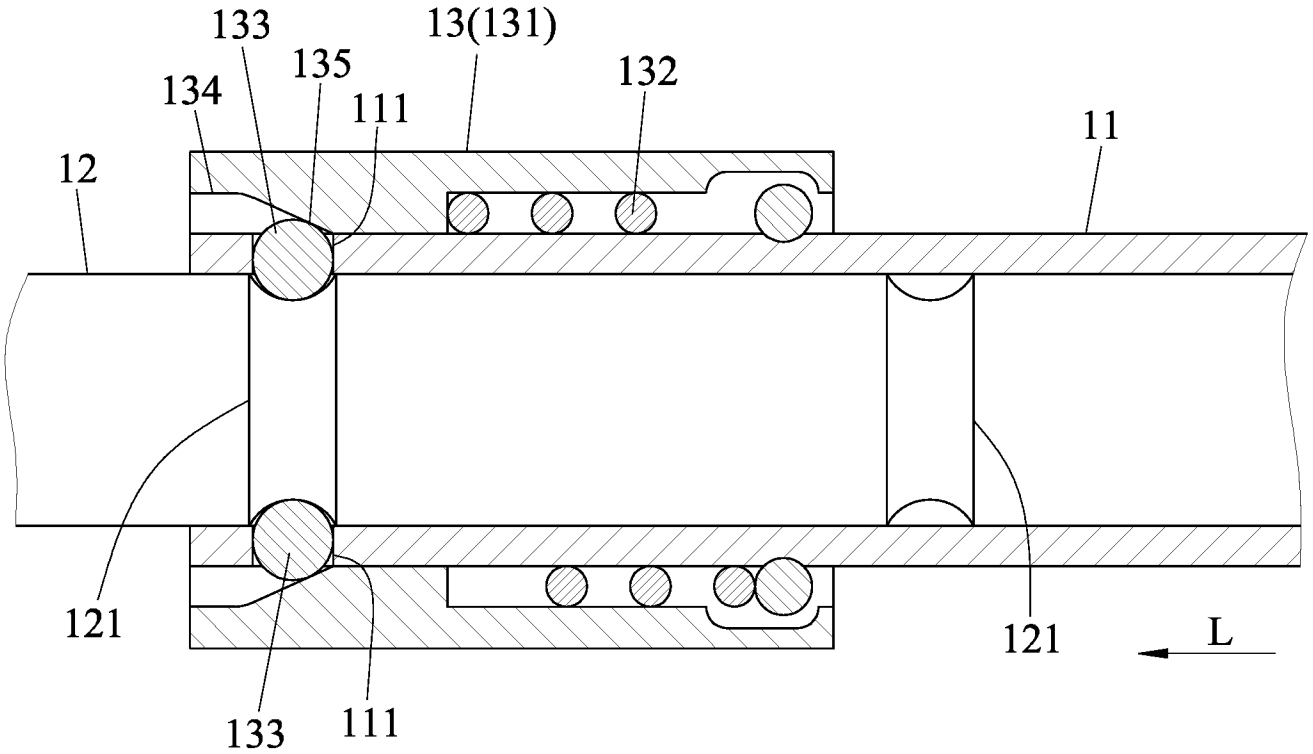
FIG.2 PRIOR ART
FIG. 2 is a fragmentary schematic sectional view of the conventional telescopic wrench shown in FIG. 1.
Figure 3:
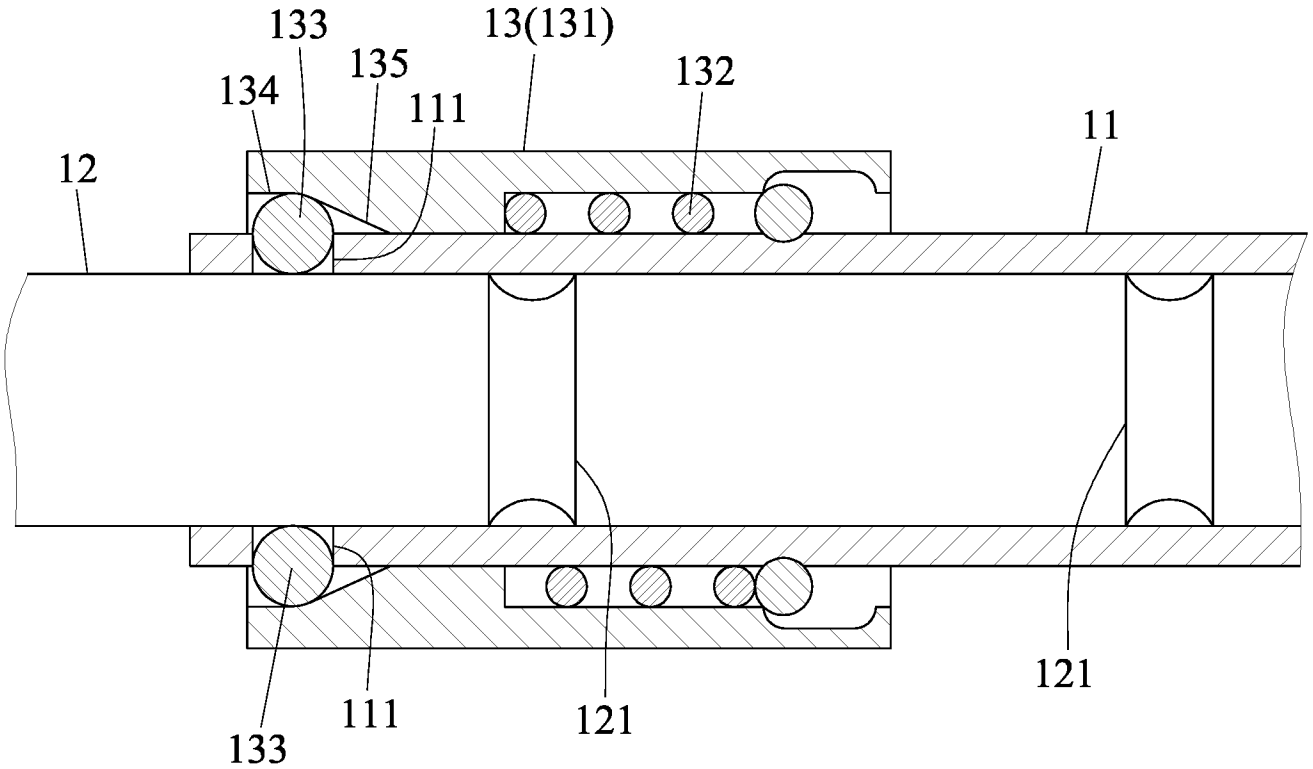
FIG.3 PRIOR ART
FIG. 3 is a fragmentary schematic sectional view similar to FIG. 2 but illustrating an inner rod being movable relative to an outer tube of the conventional telescopic wrench.
Figure 4:
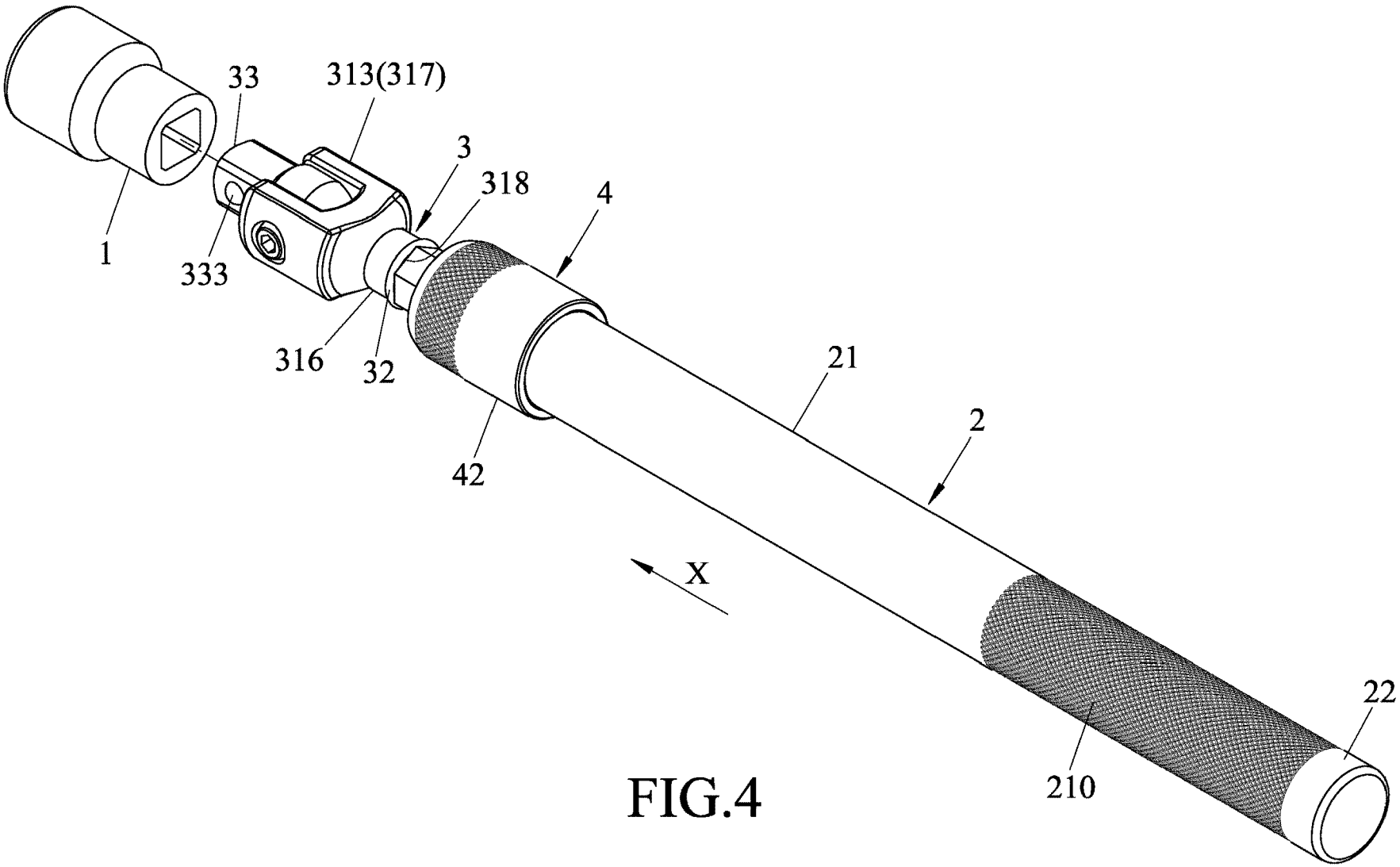
FIG. 4 is a perspective view of a wrench according to an embodiment of the present disclosure, illustrating an inner rod retracted into an outer tube of the wrench.

Referring to FIG. 4, a wrench according to an embodiment of the present disclosure is shown. The wrench includes a tool head 1, an outer tube unit 2, a rod unit 3 and a sleeve unit 4.

Figure 5:
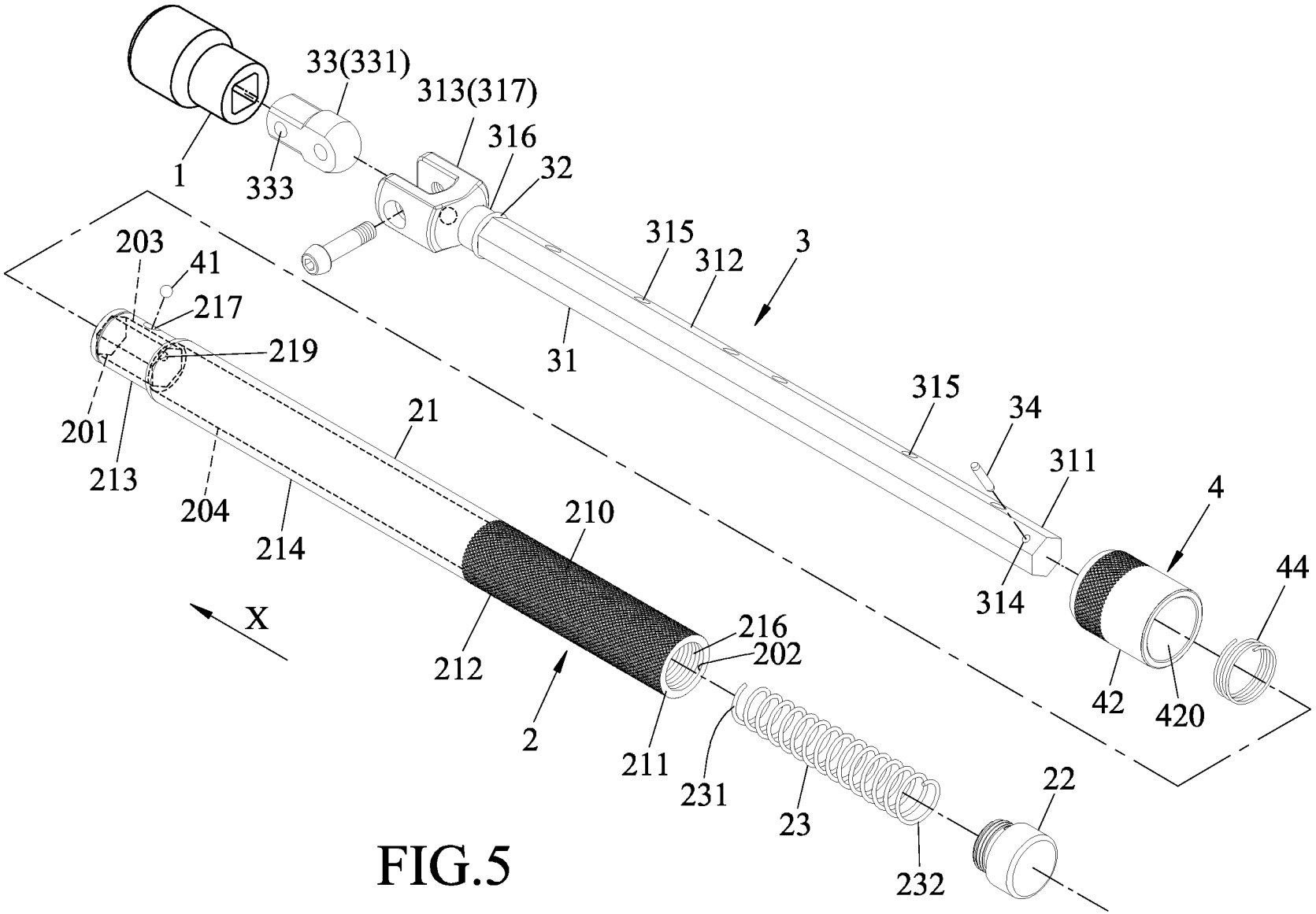
FIG. 5 is an exploded perspective view of the embodiment.
Figure 6:
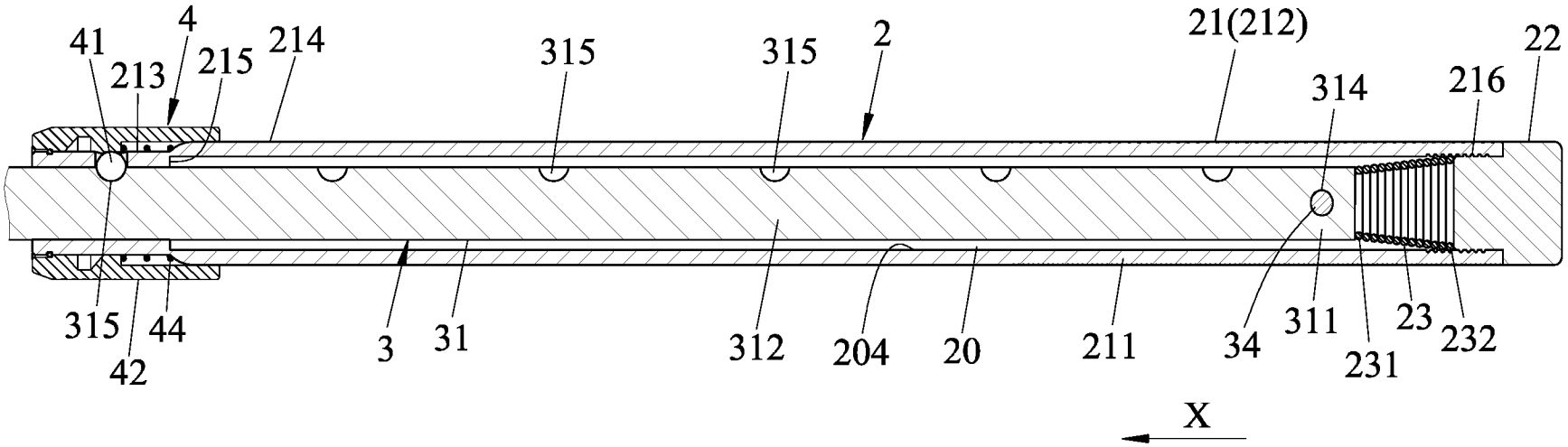
FIG. 6 is a fragmentary sectional view of the embodiment.
Figure 7:
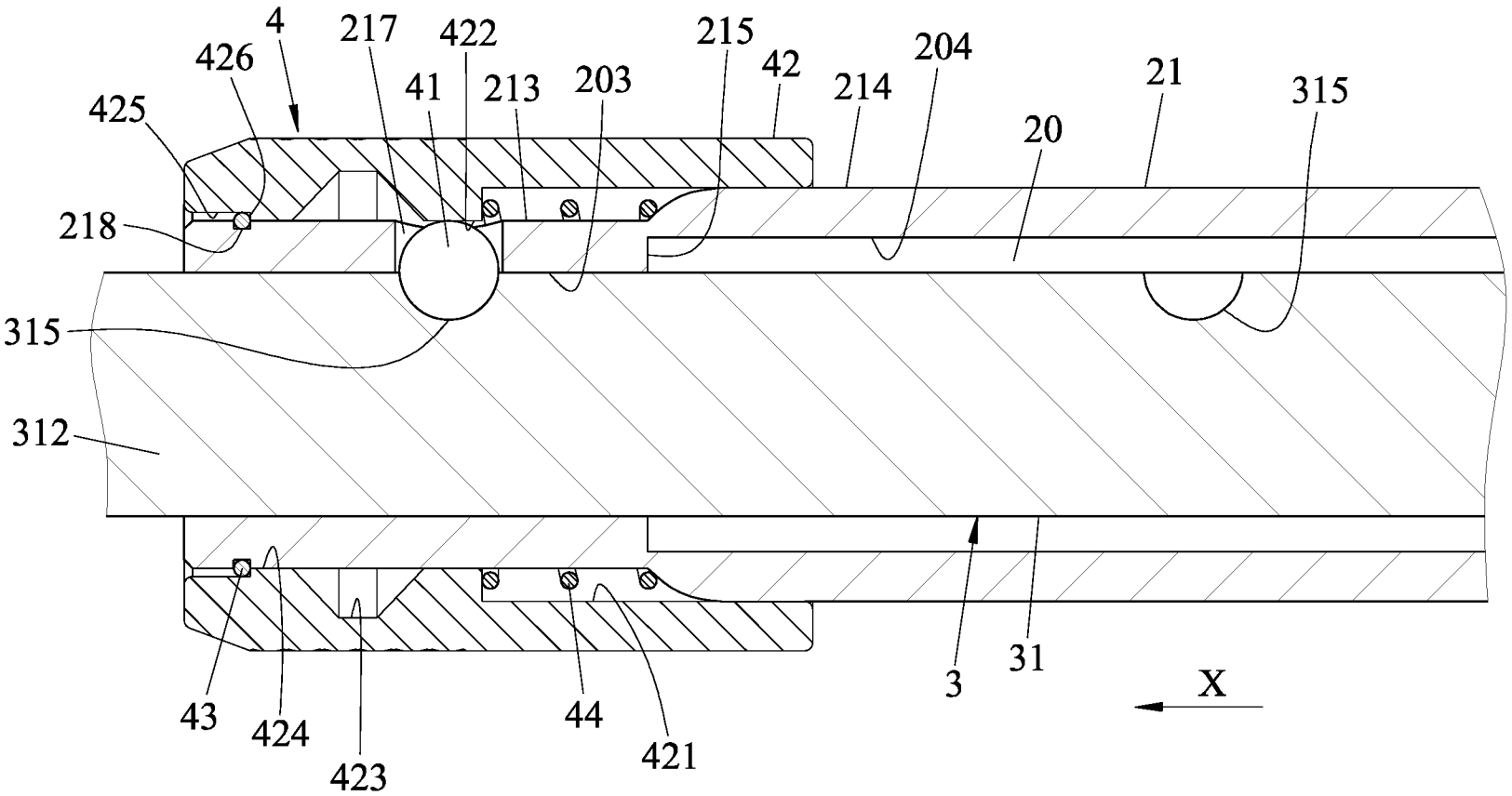
FIG. 7 is a fragmentary sectional view of the wrench of the embodiment, illustrating a movable sleeve of the wrench being at a locking position, where the inner rod is locked in the outer tube.

Further referring to FIGS. 5 to 7, the outer tube unit 2 includes an outer tube 21, a tail seat 22, and a first biasing member 23. The outer tube 21 extends along an axial direction (X) and includes a tube wall 211 that defines a tube channel 20 having a front opening 201 and a rear opening 202 opposite to the front opening 201 along the axial direction (X), and that has a front segment 213, a rear segment 212, an interconnecting segment 214, and an inner shoulder 215. The front segment 213 is formed with a positioning hole 217 extending in a radial direction transverse to the axial direction (X), and is formed with an annular groove 218 (see FIG. 7) in an outer surface of the front segment 213. The rear segment 212 is opposite to the front segment 213 along the axial direction (X), is formed with an internal thread 216 and has an anti-slip knurled outer surface 210. The front opening 201 is formed at the front segment 213 and the rear opening 202 is formed at the rear segment 212. The interconnecting segment 214 interconnects the front segment 213 and the rear segment 212, has an inner diameter larger than that of the front segment 213, has an outer diameter larger than that of the front segment 213, and is formed with a mounting hole 219. The mounting hole 219 extends in the radial direction and is misaligned with the positioning hole 217 along the axial direction (X). The inner shoulder 215 is formed between the front segment 213 and the interconnecting segment 214.

The tail seat 22 is detachably mounted to the rear segment 212 of the outer tube 21 and seals the rear opening 202. Specifically, an external thread of the tail seat 22 engages detachably the internal thread 216 formed in the outer tube 21.

The first biasing member 23 is disposed in the channel 20 at the rear segment 212 of the outer tube 21, is a frusto-conical spring, and has a first end 231 and a second end 232 opposite in the axial direction (X). The first end 231 has an outer diameter smaller than that of the second end 232 so that the first biasing member 23 is easy to be assembled into the outer tube 21. The second end 232 abuts against the tail seat 22.

The tube channel 20 has a polygonal channel section 203 terminating at the front opening 201, and a circular channel section 204 extending from the polygonal channel section 203 and terminating at the rear opening 202. In one embodiment, the front segment 213 is soldered to the interconnecting segment 214 but the present disclosure is not limited to this example.

The rod unit 3 is connected to the tool head 1, and includes an inner rod 31, an O-ring 32, a connector seat 33, and a positioning pin 34. The inner rod 31 is telescopically disposed in the tube channel 20 and includes an inner end segment 311, an extending segment 312 and an outer end segment 313. The inner end segment 311 abuts against the first end 231 of the first biasing member 23 in such a manner that the first biasing member 23 disposed between the tail seat 22 and the inner end segment 311 biases the inner rod 31 away from the tail seat 22. The extending segment 312 extends from the inner end segment 311 away from the rear opening 202 and is formed with a plurality of cavities 315 spaced apart from one another along the axis (X). The outer end segment 313 is connected to the extending segment 312 and is exposed outwardly from the front opening 201. The inner rod 31 is movable telescopically relative to the outer tube 21 to align a selected one of the cavities 315 with the positioning hole 217 of the outer tube 21 in the radial direction. Note that each of the inner end segment 311 and the extending segment 312 of the inner rod 31 has a polygonal cross section complementary in shape to the polygonal channel section 203 of the tube channel 20. In this way, rotation of the inner rod 31 relative to the outer tube 21 is prevented.

Figure 8:
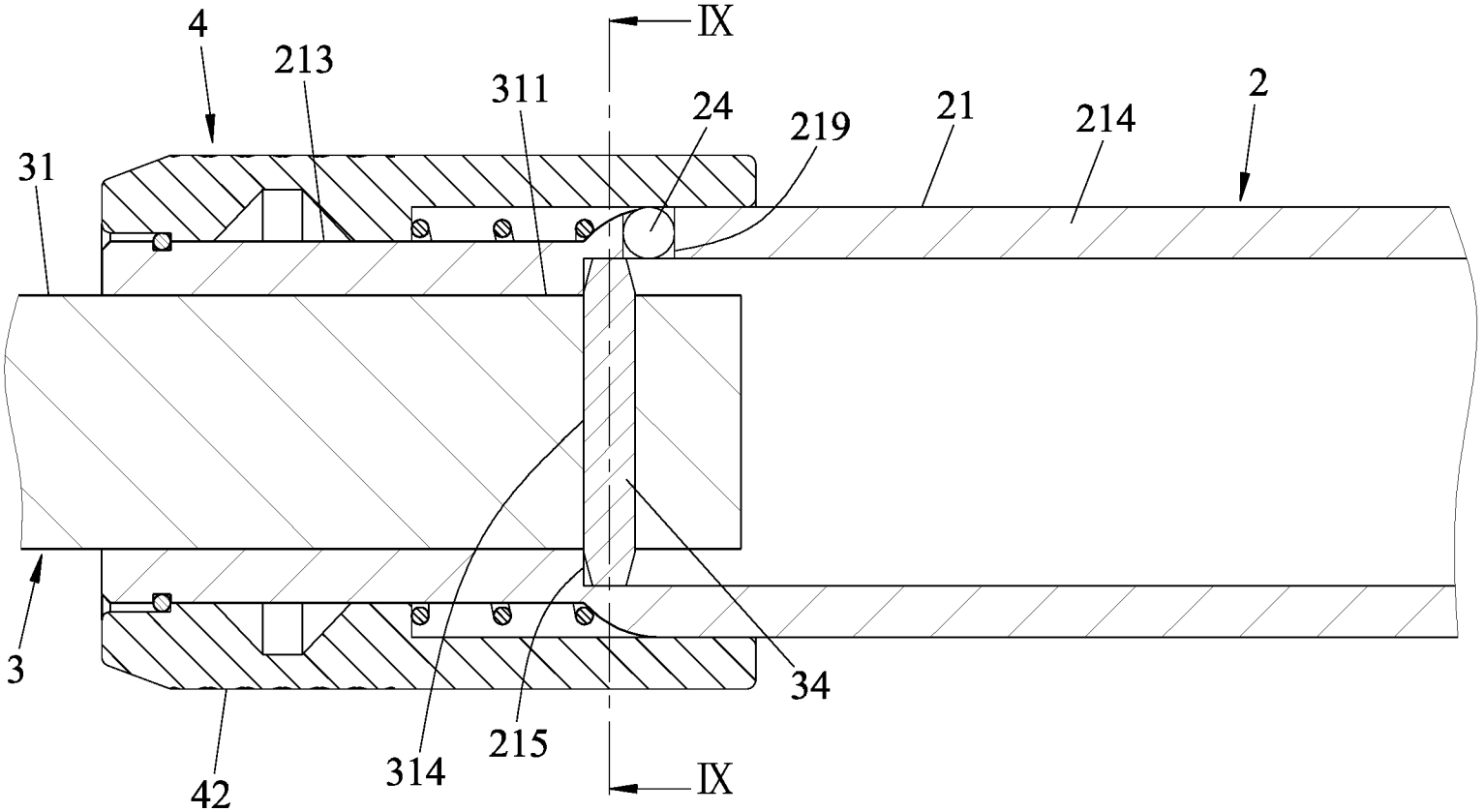
FIG. 8 is a fragmentary sectional view of the wrench of the embodiment, illustrating a pin provided for preventing the inner rod from detached from the outer tube.
Figure 9:
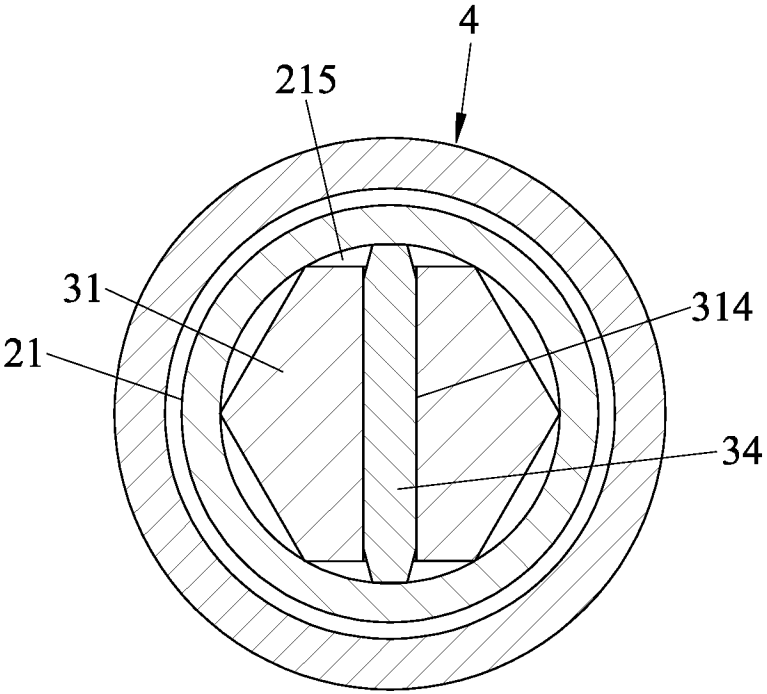
FIG. 9 is a sectional view taken along line IX-IX in FIG. 8.

Further referring to FIGS. 8 and 9, the inner end segment 311 is formed with a through hole 314 extending in the radial direction therethrough. The mounting hole 219 formed in the interconnecting segment 214 of the outer tube 21 permits the positioning pin 34 to move through the mounting hole 219 and into the through hole 314 to expose at least one end of the positioning pin 34 outwardly of the through hole 314 during assembly of the positioning pin 34 to the inner rod 31. In this embodiment, two ends of the positioning pin 34 are both exposed outwardly of the through hole 314. Thus, the positioning pin 34 extends through the through hole 314 of the inner rod 31.

As shown in FIG. 8, the outer tube unit 2 further includes a limiting ball 24 disposed in the mounting hole 219 for preventing the positioning pin 34 from being removed from the mounting hole 219. The two ends of the positioning pin 34 come into contact with the inner shoulder 215 between the front segment 213 and the interconnecting segment 214 of the outer tube 21 when the extending segment 312 of the inner rod 31 is moved forwardly within the outer tube 21, so as to prevent the inner rod 31 from detached from the outer tube 21 through the front opening 201.

In this embodiment, the outer end segment 313 is soldered to the extending segment 312. The inner rod 31 is formed with an annular groove 318 disposed at a junction between the outer end segment 313 and the extending segment 312 and receiving the O-ring 32 therein to cover the solder joint formed between the outer end segment 313 and the extending segment 312 so as to provide a relatively good aesthetics appearance.

The outer end segment 313 of the inner rod 31 has a neck portion 316 connected to the extending segment 312 and a head portion 317 connected to and extending from the neck portion 316 in a direction away from the inner end segment 311. In this embodiment, the annular groove 318 is formed between the neck portion 316 and the extending segment 312.

The connector seat 33 of the rod unit 3 is rotatably mounted to the head portion 317 of the outer end segment 313 and extends along the axial direction (X) to be connected to the tool head 1. In this embodiment, the connector seat 33 includes a pivoting portion 331 pivotally connected to the head portion 317 and a ball 333 configured to be connected to the tool head 1. Since the main feature of the present disclosure does not reside in the structures of the ball 333 and the tool head 1, further details of the same are omitted for the sake of brevity.

To assemble the rod unit 3 into the outer tube unit 2, the first biasing member 23 is first disposed into the tube channel 20 through the rear opening 202, and then temporarily rests against the internal thread 216. Next, the tail seat 22 is brought to engage the internal thread 216 and to abut against the second end 232 of the first biasing member 23 to seal the rear opening 202 of the tube channel 20. Subsequently, the inner rod 31 is inserted into the tube channel 20 through the front opening 201 to press the inner end segment 311 against the first end 231 of the first biasing member 23. Then, the positioning pin 34 is inserted into and moved through the mounting hole 219 and into the through hole 314 to expose the two ends of the positioning pin 34 outwardly of the through hole 314. Finally, the limiting ball 24 is disposed in the mounting hole 219 for preventing the positioning pin 34 from being removed from the mounting hole 219.

The sleeve unit 4 is slidably sleeved on the outer tube 21 and includes a positioning ball 41, a movable sleeve 42, and a second biasing member 44. The positioning ball 41 is mounted movably in and projects partially from the positioning hole 217 formed in the front segment 213 of the outer tube 21.

The movable sleeve 42 is movably sleeved on the front segment 213 and the interconnecting segment 214 of the outer tube 21, and includes a spring mounting segment 421, a positioning segment 422, and a large diameter segment 423. The positioning segment 422 is connected to and disposed in front of the spring mounting segment 421 and has an inner diameter smaller than that of the spring mounting segment 421. The large diameter segment 423 is connected to and disposed in front of the positioning segment 422 and has an inner diameter larger than that of the positioning segment 422.

Figure 10:
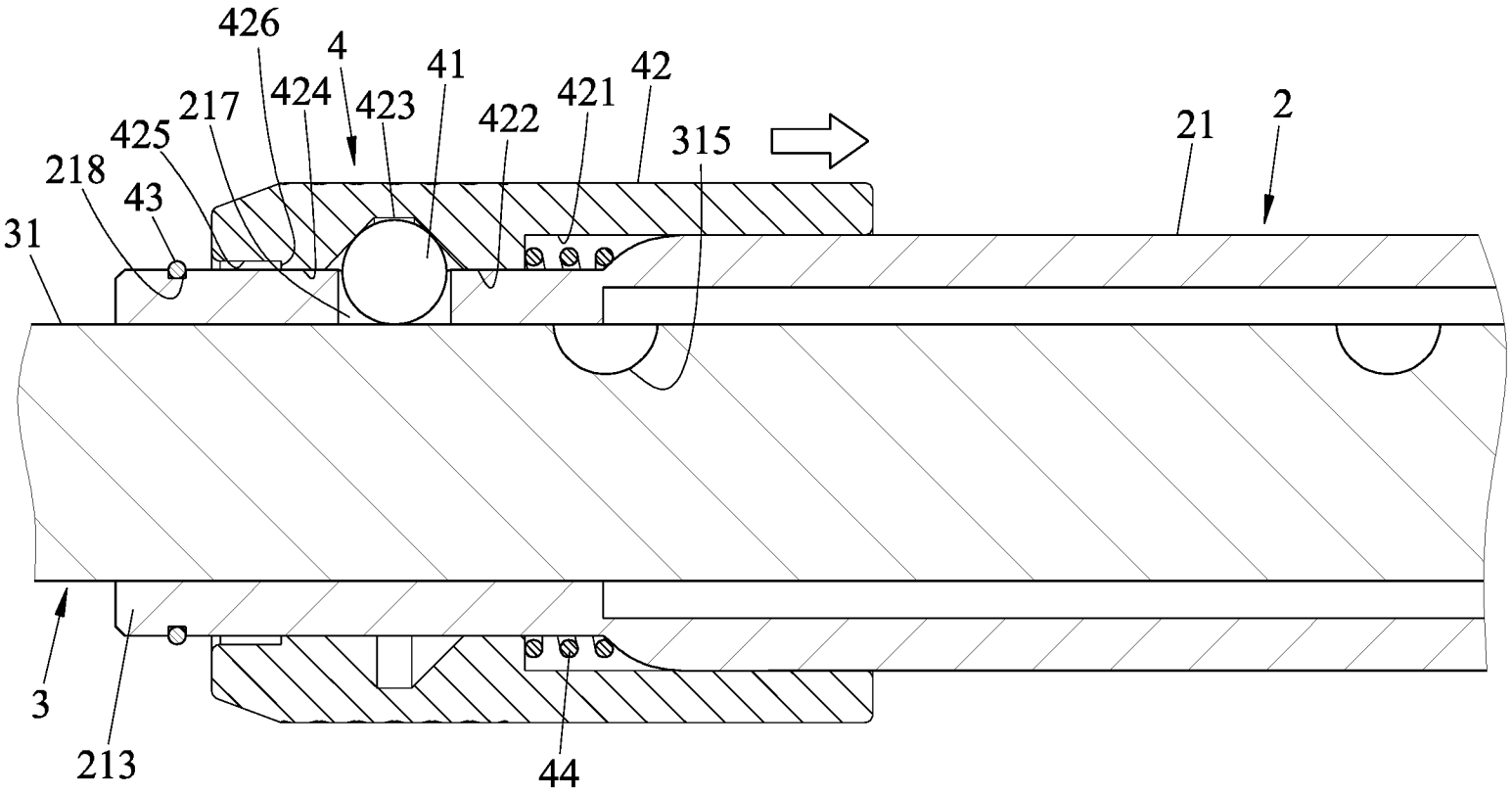
FIG. 10 is a fragmentary sectional view similar to FIG. 7, but illustrating the movable sleeve being at an adjustable position, where the inner rod is movable relative to the outer tube.

Further referring to FIG. 10, the movable sleeve 42 is movable between a locking position (see FIG. 7), where the positioning ball 41 extends fittingly into the selected one of the cavities 315 and is clamped between the positioning segment 422 of the movable sleeve 42 and the extending segment 312 of the inner rod 31 so as to prevent the inner rod 31 from moving relative to the outer tube 21, and an adjustable position (see FIG. 10), where the positioning hole 217 is aligned with the large diameter segment 423 in the radial direction and the positioning ball 41 is received in the large diameter segment 423 and is removed from the selected one of the cavities 315 so as to allow the inner rod 31 to move relative to the outer tube 21. The second biasing member 44 is sleeved on the outer tube 21, is disposed in the spring mounting segment 421 of the movable sleeve 42, and biases the movable sleeve 42 toward the locking position. In this way, length adjustment of the wrench of the present disclosure can be prevented and allowed by operating the movable sleeve 42 to the locking position and the adjustable position, respectively.

Figure 11:
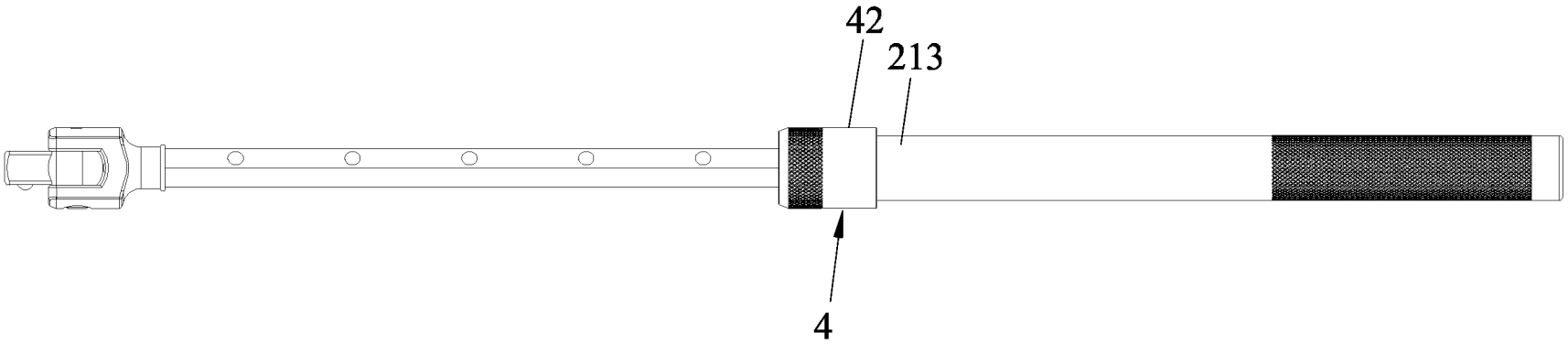
FIG. 11 is a schematic side view of the wrench, illustrating the inner rod extending outwardly of the outer tube.

In this embodiment, the sleeve unit 4 further includes an O-ring 43 received in the annular groove 218 formed on the front segment 213, and the movable sleeve 42 further includes a stop segment 424, an anterior segment 425, and an abutment shoulder 426. The stop segment 424 is connected to and disposed in front of the large diameter segment 423 and has an inner diameter smaller than that of the large diameter segment 423. The anterior segment 425 is connected to and disposed in front of the stop segment 424 and has an inner diameter larger than that of the stop segment 424. The abutment shoulder 426 is formed between the stop segment 424 and the anterior segment 425 and abuts against the O-ring 43 so as to prevent removal of the movable sleeve 42 from the front segment 213 of the outer tube 21 when the movable sleeve 42 moves toward the front opening 201 (see FIG. 11).

To sum up, by virtue of the first biasing member 23, when the inner rod 31 is retracted into the outer tube 21 to allow the length of the inner rod 31 that is exposed outwardly of the outer tube 21 to be reduced to the minimum (see FIG. 4, the inner end segment 311 is spaced apart from the tail seat 22 by the first biasing member 23, a direct impact on the tail seat 22 during using the wrench is thus prevented. Additionally, when the movable sleeve 42 is moved to the adjustable position to adjust the length of the inner rod 31 exposed outwardly of the outer tube 21, the first biasing member 23 biases the inner rod 31 away from the tail seat 22 to facilitate movement of the inner rod 31. Finally, by virtue of the design of the tail seat 22 that is detachably mounted to the rear segment 212 of the outer tube 21, it is time saving to assemble the first biasing member 23 in the tube channel 20.

Figure 12:
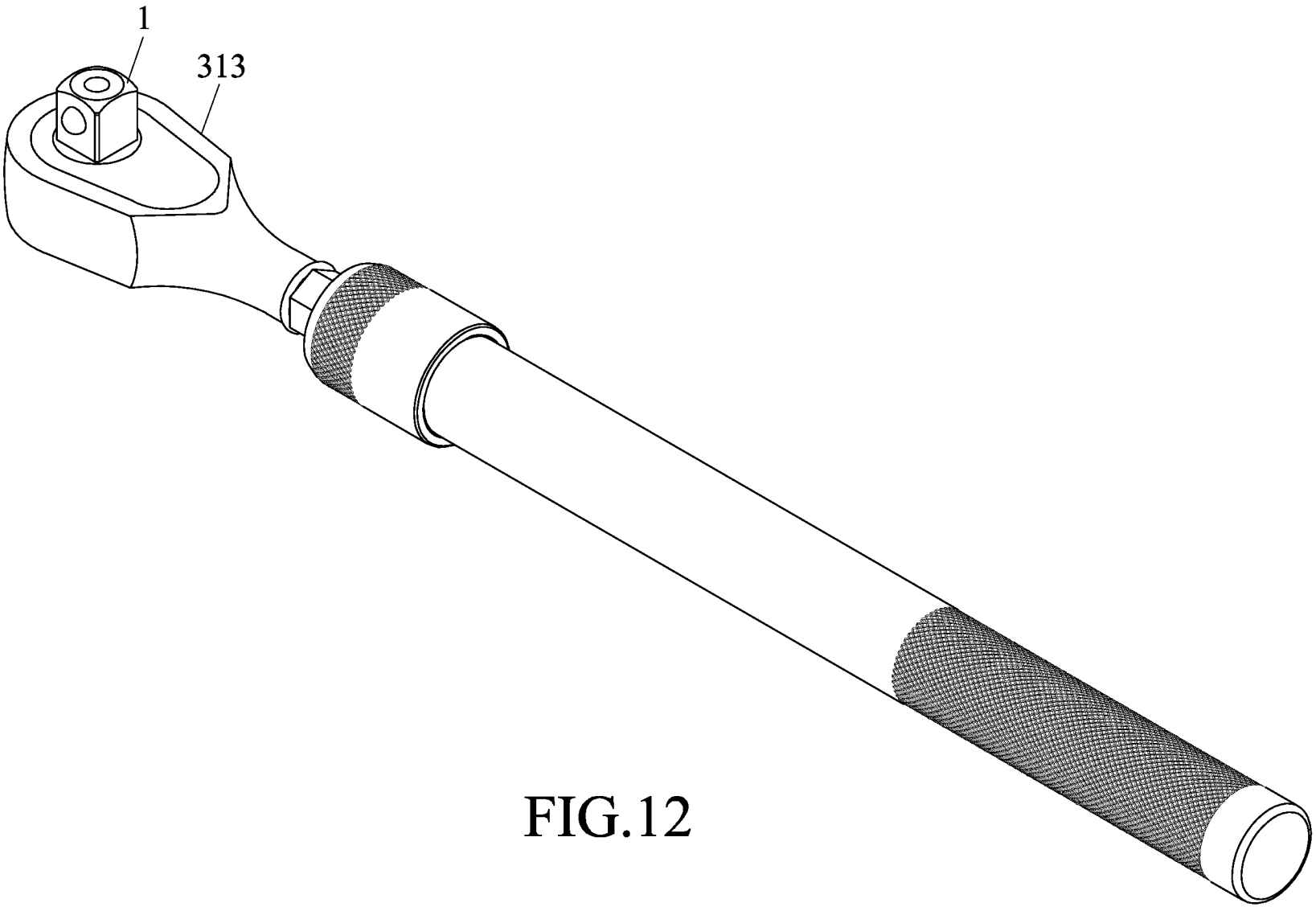
FIG. 12 is a perspective view of a modification of the wrench of the embodiment.

Referring to FIG. 12, a modification of the outer end segment 313 is shown. In this modification, the tool head 1 is configured as a ratchet head and the outer segment 313 is formed integrally to the tool head 1. Note that the configuration of the tool head 1 is not limited to the examples described herein.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A wrench comprising:

a tool head;

an outer tube unit including an outer tube extending along an axial direction and including a tube wall that defines a tube channel having a front opening and a rear opening opposite to said front opening along the axial direction, and that has a front segment formed with a positioning hole extending in a radial direction transverse to the axial direction, a rear segment opposite to said front segment along the axial direction, an interconnecting segment interconnecting said front segment and said rear segment and having an inner diameter larger than that of said front segment, and an inner shoulder formed between said front segment and said interconnecting segment, a tail seat detachably mounted to said rear segment of said outer tube and sealing said rear opening, and a first biasing member disposed in said rear segment of said outer tube and connected to said tail seat;

a rod unit connected to said tool head, and including an inner rod telescopically disposed in said tube channel and including an inner end segment that abuts against said first biasing member and that is formed with a through hole extending in the radial direction therethrough, an extending segment that extends from said inner end segment away from said rear opening and that is formed with a plurality of cavities spaced apart from one another along the axis, and an outer end segment that is connected to said extending segment and that is exposed outwardly from said front opening, said inner rod being movable telescopically relative to said outer tube to align a selected one of said cavities with said positioning hole of said outer tube in the radial direction, and a positioning pin extending through said through hole of said inner rod and having at least one end exposed outwardly of said through hole; and a sleeve unit slidably sleeved on said outer tube and including a positioning ball mounted movably in and projecting partially from said positioning hole of said outer tube, a movable sleeve movably sleeved on said front segment of said outer tube, and including a spring mounting segment, an positioning segment which is connected to and disposed in front of said spring mounting segment and which has an inner diameter smaller than that of said spring mounting segment, and a large diameter segment which is connected to and disposed in front of said positioning segment and which has an inner diameter larger than that of said positioning segment, said movable sleeve being movable between a locking position, where said positioning ball extends fittingly into said selected one of said cavities and is clamped between said positioning segment of said movable sleeve and said extending segment of said inner rod so as to prevent said inner rod from moving relative to said outer tube, and an adjustable position, where said positioning hole is aligned with said large diameter segment in the radial direction and said positioning ball is received in said large diameter segment and is removed from said selected one of said cavities so as to allow said inner rod to move relative to said outer tube, said at least one end of said positioning pin of said telescopic rod unit coming into contact with said inner shoulder formed between said front segment and said interconnecting segment of said outer tube when said extending segment of said inner rod is moved forwardly within said outer tube, so as to prevent said inner rod from being detached from said outer tube through said front opening, a second biasing member sleeved on said outer tube, disposed in said spring mounting segment of said movable sleeve, and biasing said movable sleeve toward the locking position.

2. The wrench as claimed in claim 1, wherein said first biasing member has a first end and a second end opposite in the axial direction and abutting respectively against said inner end segment of said inner rod and said tail seat for biasing said inner rod away from said tail seat.

3. The wrench as claimed in claim 2, wherein said rear segment of said outer tube is formed with an internal thread engaging threadedly said tail seat.

4. The wrench as claimed in claim 2, wherein said first biasing member is a frustoconical spring, and said first end of said first biasing member has an outer diameter smaller than that of said second end of said first biasing member.

5. The wrench as claimed in claim 1, wherein said interconnecting segment of said outer tube is formed with a mounting hole extending in the radial direction, misaligned with said positioning hole along the axial direction, and permitting said positioning pin to move through said mounting hole and into said through hole to expose said at least one end outwardly of said through hole during assembly of said positioning pin to said inner rod, said outer tube unit further including a limiting ball disposed in said mounting hole for preventing said positioning pin from being removed from said mounting hole.

6. The wrench as claimed in claim 1, wherein each of said inner end segment and said extending segment of said inner rod has a polygonal cross section, said tube channel having a polygonal channel section complementary in shape to said inner end segment and said extending segment of said inner rod and terminating at said front opening, and a circular channel section extending from said polygonal channel section and terminating at said rear opening.

7. The wrench as claimed in claim 6, wherein said outer end segment is soldered to said extending segment, said front segment is soldered to said interconnecting segment.

8. The wrench as claimed in claim 7, wherein said telescopic rod unit further includes an O-ring, said inner rod being formed with an annular groove disposed at a junction between said outer end segment and said extending segment and receiving said O-ring therein.

9. The wrench as claimed in claim 1, wherein said front segment of said outer tube unit is formed with an annular groove, said sleeve unit further including an O-ring received in said annular groove, said movable sleeve further including a stop segment that is connected to and disposed in front of said large diameter segment and that has an inner diameter smaller than that of said large diameter segment, an anterior segment that is connected to and disposed in front of said stop segment and that has an inner diameter larger than that of said stop segment, and an abutment shoulder that is formed between said stop segment and said anterior segment, said abutment shoulder abutting against said O-ring so as to prevent removal of said movable sleeve from said front segment of said outer tube when said movable sleeve moves toward said front opening.

* * * * *